US008505295B2

(12) United States Patent
Suzuki et al.

(10) Patent No.: US 8,505,295 B2
(45) Date of Patent: Aug. 13, 2013

(54) WORKING FLUID ACCUMULATION DEVICE

(75) Inventors: Michinobu Suzuki, Susono (JP); Yasuhiro Kobayashi, Anjo (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 909 days.

(21) Appl. No.: 12/639,081

(22) Filed: Dec. 16, 2009

(65) Prior Publication Data

US 2010/0146959 A1 Jun. 17, 2010

(30) Foreign Application Priority Data

Dec. 16, 2008 (JP) ..... 2008-320257

(51) Int. Cl.
*F15B 1/26* (2006.01)

(52) U.S. Cl.
USPC ..... 60/585; 60/584

(58) Field of Classification Search
USPC ..... 60/584, 585; 192/85.55, 85.6
See application file for complete search history.

(56) References Cited

U.S. PATENT DOCUMENTS 2,625,267 A * 1/1953 Alexander ..... 60/592
4,414,810 A * 11/1983 Reinartz et al. ..... 60/585
4,441,520 A * 4/1984 Bruso et al. ..... 60/585
5,988,340 A * 11/1999 Riess ..... 192/85.6
6,840,044 B2 * 1/2005 Leboisne ..... 60/585
7,980,075 B2 * 7/2011 Sato ..... 60/585

FOREIGN PATENT DOCUMENTS

JP 59037402 U 3/1984
JP 59194645 U 12/1984
JP 59194645 U * 12/1984
JP 355958 5/1991
JP 05332301 A * 12/1993
JP 05332301 A 12/1993
JP 2002276605 A 9/2002

* cited by examiner

*Primary Examiner* — Thomas E Lazo
(74) *Attorney, Agent, or Firm* — Gifford, Krass, Sprinkle, Anderson & Citkowski, P.C.

(57) ABSTRACT

A reservoir device is provided, which prevents water from flooding in an accumulation tank and improves on-vehicle installation capability. The reservoir device 10 includes a catch tank 13 connected to an airspace "A" formed above an oil surface of working oil accumulated in an accumulation tank 12, which has a bottom surface formed with an external-air communication aperture 32. Liquid entering from the external-air communication aperture 32 is allowed, to be accumulated in the catch tank 13 once, and then is suitably discharged through the external-air communication aperture 32. This precludes the accumulation tank 12 from flooding with water and improves on-vehicle installation capability. The reservoir device 10 can be obtained, in which the accumulation tank 12 is prevented from flooding with water, even if the reservoir tank 10 is placed in a place or the like relatively closer to for instance a road surface with an ease of suffering water splashing during a traveling in a rainy weather or a traveling on a submerged road surface or the like.

8 Claims, 3 Drawing Sheets

WORKING FLUID ACCUMULATION DEVICE

CROSS REFERENCE TO RELATED APPLICATIONS

This Application claims priority of Japanese Patent Application No. 2008-320257 filed on Dec. 16, 2008, which is incorporated herein by reference.

FIELD OF THE INVENTION

This invention relates to working fluid accumulation device having an accumulation tank for accumulating working fluid, and more particularly, to a technology of preventing an accumulation tank from flooding with water from an outside.

DESCRIPTION OF THE RELATED ART

There has heretofore been known a working fluid accumulation device including an accumulation tank for accumulating working fluid used for a hydraulic device such as a clutch device and a braking device, etc., of a vehicle under atmospheric pressure. The accumulation tank has an upper space or place provided with an atmospheric open hole for absorbing a pressure variation caused by a volumetric variation of working fluid accumulated in an internal space or place. Therefore, with a view to preventing or precluding the internal space of the accumulation tank from flooding, with liquid i.e., water entry entering through the atmospheric open hole during a traveling in for instance a rainy weather or during a traveling on a submerged road surface or the like, the accumulation tank is located in a space relatively higher than the road surface on which the vehicle travels.

Further, even if the accumulation tank can not be located in such a high place, for instance, Patent Publication 1 (Japanese Utility Model Publication No. 3-55958) discloses a structure in which the accumulation tank is prevented from flooding with water. That is, there is provided an oil supply cylinder, extending upward from the accumulation tank, which has an upper end opening portion closable by a cap that is formed with an atmospheric open hole. This allows the atmospheric open hole acting as a retting port to be located at a relatively high place, thereby preventing the flooding of water. Apart from this, further, even if the working fluid accumulation device, etc., includes a breather valve or a sub-tank or the like which are located at a relatively high place in communication with the inside of the accumulation tank, the inside of the accumulation tank can be prevented from flooding with water.

However, the conventional working fluid accumulation device has a need to locate the oil supply cylinder, the breather valve or the sub-tank, etc., at the high place in lieu of no need arising to locate the accumulation tank at the high place. In addition, there is a need to prepare a piping space for a delivery tube for connecting them and the accumulation tank to each other. Moreover, with the sub-tank being provided, an air sump portion needs to be located at a high place to preclude air from entering into a liquid pressure delivery tube of the hydraulic device, so that a regular air-bleeding work is required.

SUMMARY OF THE INVENTION

The present invention has been completed with the above view in mind, and has an object to provide a working fluid accumulation device that can prevent its accumulation tank from flooding with water, and is improved in on-vehicle installation capability.

For achieving the above object, a first aspect of the present invention provides a working fluid accumulation device for a hydraulic device having an accumulation tank connected to a vehicular hydraulic device to accumulate working fluid therein under an atmospheric pressure. The working fluid accumulation device comprises a catch tank being connected to a space formed above a liquid surface of the working fluid in the accumulation tank and having a bottom portion formed with an external-air communication aperture.

A second aspect of the present invention is featured by, in the first aspect, that the catch tank has a capacity greater than a predetermined volumetric variation of the working fluid to be accumulated in the accumulation tank.

A third aspect of the present invention is featured by, in the first or second aspect, that the external-air communication aperture is constructed of an inner bore of a tubular member formed on the bottom portion of the catch tank so as to protrude downward, and a bottom surface of the catch tank has a sloped shape descending toward the external-air communication aperture.

A fourth aspect of the present invention is featured by, in any one of the first to third aspects, that the catch tank internally has a first flow restricting plate provided intersecting with a streamline between a connecting port formed in the catch tank in connection to the accumulation tank, and the external-air communication aperture.

A fifth aspect of the present invention is featured by, in any one of the first to fourth aspects, that the accumulation tank has a connecting port communicating with an inside of the accumulation tank, the catch tank is located in a space beneath the accumulation tank, and the connecting port of the catch tank and the connecting port of the accumulation tank are connected to each other through a connecting pipe.

A sixth aspect of the present invention is featured by, in the fifth aspect, that the accumulation tank has a fill-in port formed on the accumulation tank at an upper portion thereof for filling the working fluid, and a cap closing the fill-in port and being provided with the connecting port of the accumulation tank.

A seventh aspect of the present invention is featured by, in any one of the fourth to sixth aspects, that a gap is provided between the first flow restricting plate and a bottom surface of the catch tank.

A eighth aspect of the present invention is featured by, in any one of the fourth to seventh aspects, that a gap is provided between the first flow restricting plate and a side surface of the catch tank, a second flow restricting plate is disposed between the gap and the external-air communication aperture intersecting with a streamline between the gap and the external-air connection aperture, and the first and second flow restricting plates form a labyrinth path in the catch tank so as to extend from the external-air communication aperture to the connecting port.

According to the working fluid accumulation device for a hydraulic device of the first aspect, the catch tank is connected to the space formed above the liquid surface of the working fluid in the accumulation tank and has the bottom portion formed with the external-air communication aperture. Accordingly, liquid entering through the external-air communication aperture, is accumulated in the catch tank once, and then liquid is suitably discharged through the external-air communication aperture. This prevents the accumulation tank from flooding with water, and improves its on-vehicle installation capability. Thus, a working fluid reservoir device can be obtained, which can prevent the inside of the accumulation tank from flooding with water, even if the accumulation tank is installed in a place or space or the like relatively closer to a road surface to be easily splashed with water during for instance a traveling of a vehicle in rainy weather or during a traveling on a submerged road surface.

According to the working fluid accumulation device for a hydraulic device of the second aspect, the catch tank has the capacity greater than the predetermined volumetric variation of the working fluid to be accumulated in the accumulation tank. Under a circumstance where for instance a part of or a whole of the working fluid accumulation device including the external-air communication aperture is submerged in liquid, working fluid may decrease in the accumulation tank by a predetermined volumetric variation. Even under such likelihood, a whole of liquid drawn through the external-air communication aperture with the occurrence of such a volumetric variation can be accumulated in the catch tank. Thus, even if the working fluid accumulation device is soaked in liquid such as water, the accumulation tank can be prevented from flooding with water.

According to the working fluid accumulation device for a hydraulic device of the third aspect, the external-air communication aperture is constructed of the inner bore of a tubular member formed on the bottom portion of the catch tank so as to protrude downward, and the bottom surface of the catch tank has the sloped shape descending toward the external-air communication aperture. Thus, the catch tank has a structure that can easily discharge liquid accumulated therein through the external-air communication aperture. This can efficiently discharge liquid entering from the external-air communication aperture.

According to the working fluid accumulation device for a hydraulic device of the fourth aspect, the catch tank internally has the first flow restricting plate provided intersecting with the streamline between the connecting port formed in the catch tank in connection to the accumulation tank, and the external-air communication aperture. Accordingly, the flow restricting plate increases the flow path between the external-air communication aperture and the connecting port formed inside the catch tank, thereby preventing liquid contained in fluid passing with the flow of fluid directed to the connecting port from the external-air communication aperture from entering into the accumulation tank. There is a likelihood that fluid is caused to splash toward the external-air communication aperture from the outside, and that fluid is swiftly sucked through the external-air communication aperture due to a rapid volumetric variation of working fluid in the accumulation tank. Even under such states, the flow restricting plate weakens momentum of such fluid, so that the accumulation tank is prevented from flooding with water caused by the flow of fluid directed from the external-air communication aperture to the connecting port.

According to the working fluid accumulation device for a hydraulic device of the fifth aspect, the accumulation tank has the connecting port communicating with the inside of the accumulation tank, the catch tank is located in the space beneath the accumulation tank, and the connecting port of the catch tank and the connecting port of the accumulation tank are connected to each other through the connecting pipe. With the accumulation tank having the connecting port placed in the place or space above the connecting port of the catch tank, fluid accumulated in the catch tank hardly flows into the accumulation tank, thereby preventing the accumulation tank from flooding with water in a further effective effect.

According to the working fluid accumulation device for a hydraulic device of the sixth aspect, the accumulation tank has the fill-in port formed on the accumulation tank at the upper portion thereof for filling the working fluid, and the cap closing the fill-in port and being provided with the connecting port of the accumulation tank. With the accumulation tank having the cap formed with the connecting port placed in the place or space above the connecting port of the catch tank, fluid accumulated in the catch tank hardly flows into the accumulation tank, thereby preventing the accumulation tank from flooding with water in a further effective effect.

According to the working fluid accumulation device for a hydraulic device of the seventh aspect, the gap is provided between the first flow restricting plate and the bottom surface of the catch tank. Therefore, liquid accumulated in the catch tank in the place or space between the first flow restricting plate and the connecting port is cause to pass through the gap such that liquid can be easily discharged through the external-air communication aperture. Thus, liquid accumulated in the catch tank from is efficiently discharged.

According to the working fluid accumulation device for a hydraulic device of the eighth aspect, the gap is provided between the first flow restricting plate and the side surface of the catch tank, the second flow restricting plate is disposed between the gap and the external-air communication aperture intersecting with the streamline between the gap and the external-air connection aperture, and the first and second flow restricting plates form a labyrinth path in the catch tank so as to extend from the external-air communication aperture to the connecting port. This lengthens flow path between the external-air communication aperture of the catch tank and the connecting port, so that liquid contained in fluid, passing with the flow of fluid directed from the external-air communication aperture to the connecting port, can be prevented from entering the accumulation tank.

DETAILED DESCRIPTION OF THE PREFERRED EMBODIMENTS

Now, one embodiment of the present invention will be described below in detail with reference to the accompanying drawings. In the illustrated embodiment described below, further, component parts are suitably simplified or modified in drawing with no component parts being necessarily and accurately plotted in dimensional ratio and shapes or the like.

Embodiment

Figure 1:
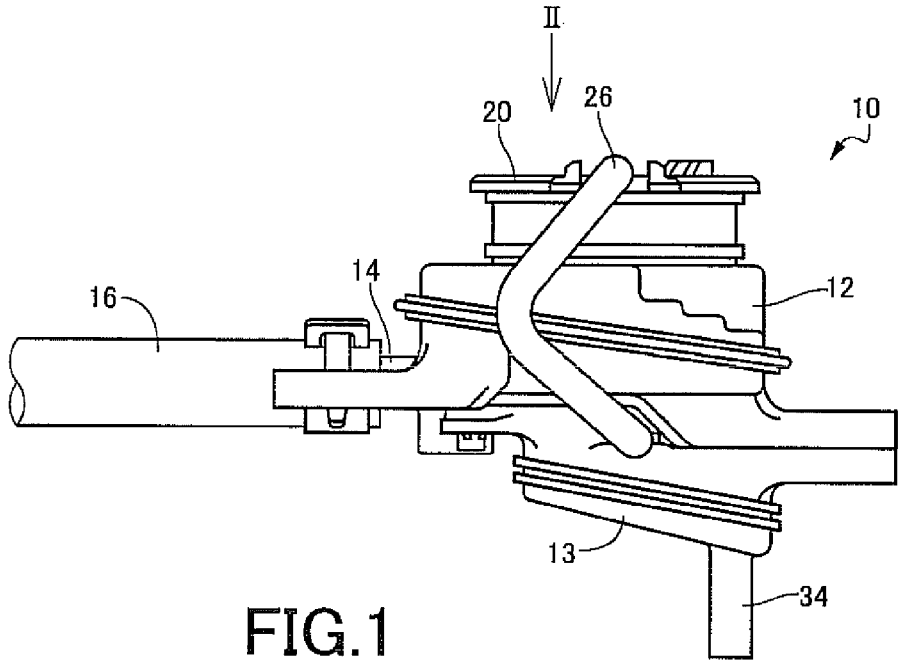
FIG. 1 is a front view showing a reservoir device of one embodiment according to the present invention.
Figure 2:
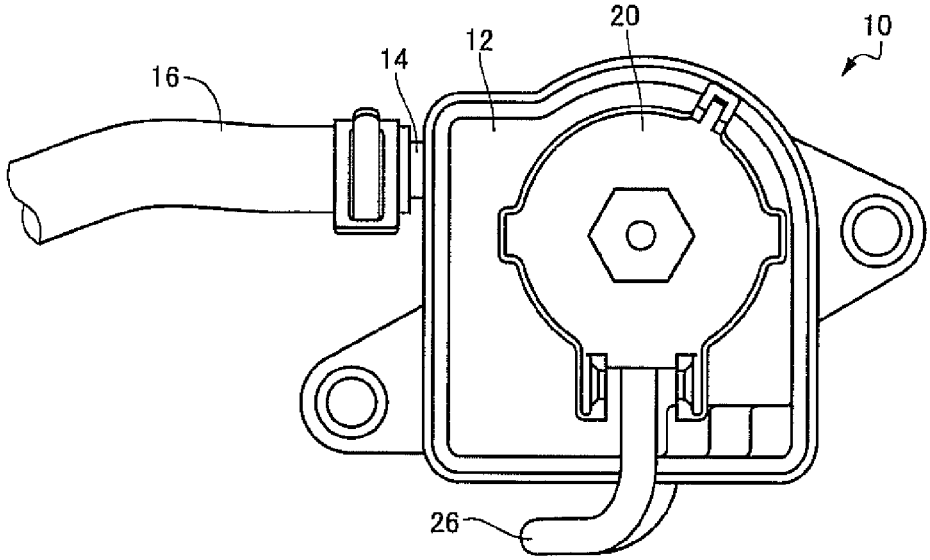
FIG. 2 is a top view of the reservoir device representing a fragmentary section on arrow II of FIG. 1.

FIG. 1 is a front view showing a reservoir device (working fluid accumulation device) 10 of one embodiment according to the present invention and FIG. 2 is a top view showing the reservoir device 10 representing a fragmentary section on arrow II of FIG. 1. In FIGS. 1 and 2, the reservoir device 10 of the present embodiment is connected to a vehicular clutch device (hydraulic device), which is not sown. The clutch device includes a clutch master cylinder (not shown) that generates a liquid pressure depending on input operation and the reservoir device 10 is a device for accumulating a surplus of working oil (working fluid) used in such a clutch master cylinder under an atmospheric pressure.

Figure 3:
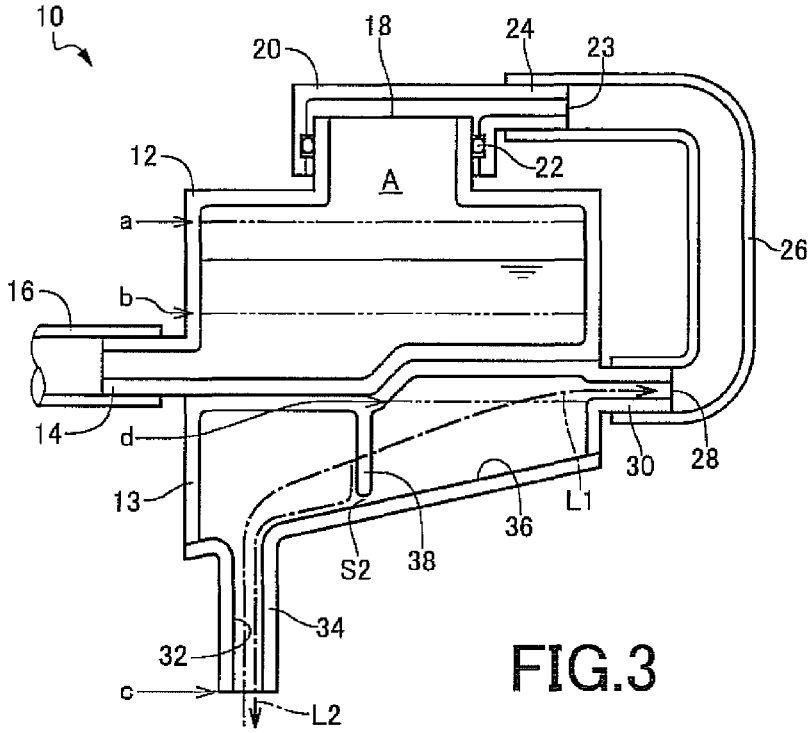
FIG. 3 is a cross-sectional view typically showing the reservoir device shown in FIG. 1, while representing a cross-sectional view showing a fragmentary section on arrow III-III of FIG. 5.

FIG. 3 is a cross-sectional view typically showing the reservoir device 10 of the present embodiment. In FIGS. 1 to 3, the reservoir device 10 includes an accumulation tank 12 for accumulating the surplus of working oil, and a catch tank 13 fixedly attached to the accumulation tank 12 at a lower space thereof. With the reservoir device 10 shown in FIG. 3, for the sake of convenience, major component parts (involving a connecting pipe 14 and an open-air communicating tube 24 that will be described later) of the accumulation tank 12, and other major component parts (involving a connecting pipe 30 and an external-air communicating tube 34 that will be described later) of the catch tank 13, are shown in a coplanar place. In addition, the catch tank 13 shown in FIG. 3 represents a cross section of a fragmentary section on arrow III-III of the catch tank 13 shown in FIG. 5.

The accumulation tank 12 has the connecting pipe 14 for connecting an inside of the accumulation tank 12 and a hydraulic chamber of the clutch master cylinder to each other. The connecting pipe 14 has a distal end formed with an opening held in communication with the accumulation tank 12 at a bottom surface thereof or a neighboring side surface thereof. Likewise, a rubber tube 16 has one end tightly fitted to a connecting pipe (not sown) provided on the clutch master cylinder, and the other end tightly fitted to the connecting pipe 14 with no gap. The inside of the accumulation tank 12 is connected to the hydraulic pressure chamber of the clutch master cylinder via inner bores of the connecting pipe 14 and the rubber tube 16.

Further, the accumulation tank 12 has an upper plane (upper space) formed with a fill-in port 18 held in communication with an interior of the accumulation tank 12 for filling working oil. Furthermore, a cap 20 is detachably fitted to the fill-in port 18 of the accumulation tank 12 for tightly closing the fill-in port 18. With the present embodiment, the cap 20 internally carries thereon an O-ring 22 serving as a seal member to tightly close the fill-in port 18. Moreover, the cap 20 has a side surface from which a connecting pipe 24 protrudes with a distal end formed with a connecting port 23 held in communication having the inside of the accumulation tank 12. In addition, the connecting pipe 24 has one end to which one end of a rubber tube 26 is tightly fitted with no gap and serves as a connecting pipe for connecting the accumulation tank 12 and the catch tank 13 to each other.

Figure 4:
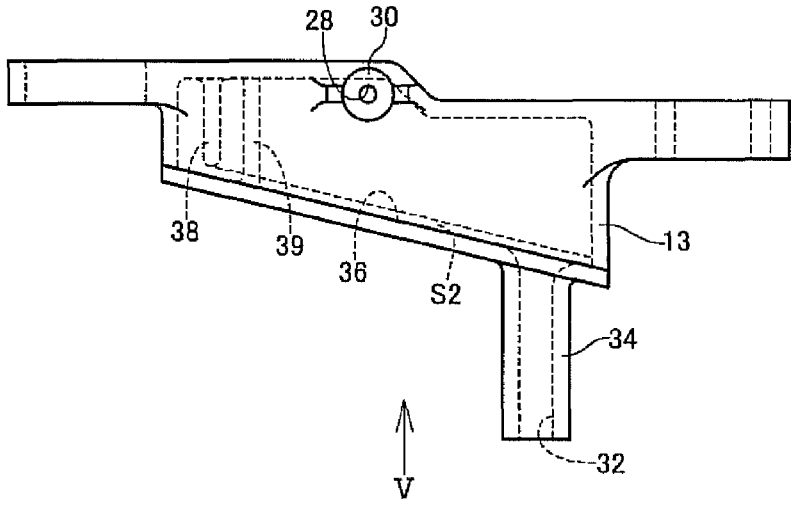
FIG. 4 is a front view showing a catch tank shown in FIG. 1.
Figure 5:
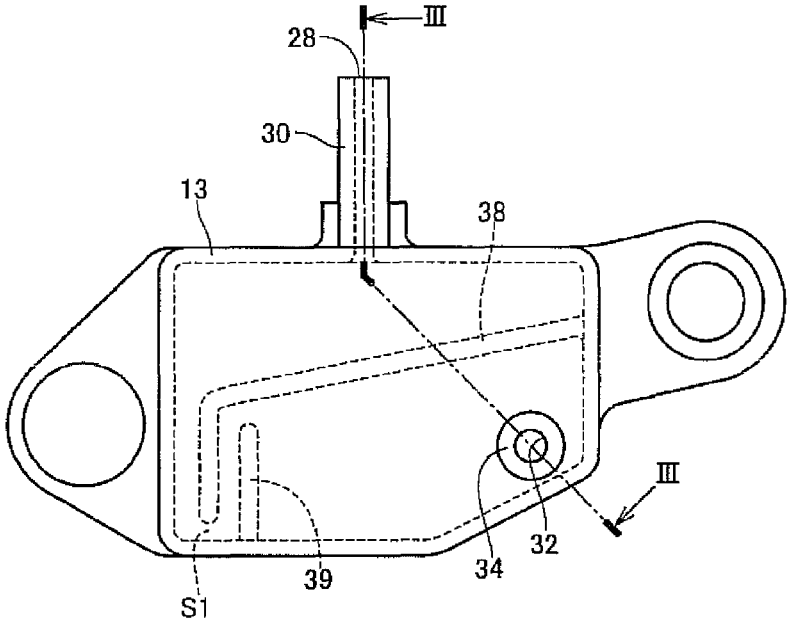
FIG. 5 is a bottom view of the catch tank representing a fragmentary section on arrow V in FIG. 4.

FIG. 4 is a front view of the catch tank 13 shown in FIG. 1. FIG. 5 is a bottom view of the catch tank 13 representing a fragmentary area on arrow V in FIG. 4. As shown in FIGS. 4 and 5, the catch tank 13 has an upper outer side surface from which a connecting pipe 30 having a distal end formed with a connecting port 28 held in communication with the catch tank 13 at an upper space or a neighboring side surface thereof, is protruded. The other end of the rubber tube 26 is tightly fitted to the connecting pipe 30 with no gap. The connecting port 28 of the catch tank 13 and the connecting port 23 of the accumulation tank 12 are connected to each other via the rubber tube 26. In addition, an interior of the catch tank 13 is connected to an airspace "A" formed in the accumulation tank 12 at an oil surface (liquid surface) of working oil accumulated therein, via inner bores of the rubber tube 26, the connecting pipe 30 and the connecting pipe 24.

Further, the catch tank 13 has a bottom wall formed with an external-air communication aperture 32. The external-air communication aperture 32 is formed with an inner bore of an external-air communication pipe (tubular member) 34 that extends downward from the bottom wall of the catch tank 13. With the present embodiment, the external-air communication aperture 32 is formed on the catch tank 13 in a space near the side surface thereof at a position opposite to another side surface in which the connecting pipe 30 is provided. Further, the catch tank 13 internally has a bottom surface 36 formed in a sloped shape descending downward toward the external-air communication aperture 32. That is, the external-air communication aperture 32 is provided on the catch tank 13 at one end of the bottom surface 36 that is tapered in shape such that the external-air communication aperture 32 is located at the lowermost position.

As set forth above, the catch tank 13 shown in FIG. 3 represents a fragmentary area as viewed on an arrow III-III of FIG. 5. In FIGS. 3 to 5, the catch tank 13 internally has a first flow restricting plate 38 provided so as to intersect with a hypothetical streamline (streamline) L1 between the connecting port 28 of the catch tank 13 provided for connection to the accumulation tank 12, and the external-air communication aperture 32. As used herein, the term "streamline L1" refers to a minimal distance streamline for fluid to pass from the connecting port 28 to the external-air communication aperture 32 when no first flow restricting plate 38 is provided. The first flow restricting plate 38 has one horizontal end and an upper end fixedly connected to a side surface and an upper surface of the catch tank 13, respectively, to be formed unitarily with the catch tank 13. Given gaps S1 and S2 are provided between the other end face and a lower end face of the first flow restricting plate 38 and the side surface and the bottom surface 36 of the catch tank 13 to allow fluid flow. In addition, the catch tank 13 internally has a second flow restricting plate 39 provided so as to intersect with a streamline oriented from the external-air communication aperture 32 to a gap S1 formed between the other end face of the first flow restricting plate 38 and an opposing end face. With the present embodiment, the first and second flow restricting plates 38 and 39 provided between the connecting port 28 and the external-air communication aperture 32 form a labyrinth path to lengthen the flow path between the first and second flow restricting plates 38 and 39.

Further, the catch tank 13 has a capacity set to be larger than a predetermined volumetric variation of working oil accumulated in the accumulation tank 12. Here, the predetermined volumetric variation of working oil is obtained on experimental tests, based on a variation in volume of working oil varying from a predetermined maximal temperature to a minimal temperature due to for instance a variation in climate and a variation in drive state. With the present embodiment, the predetermined volumetric variation of working oil is set to a volumetric variation appearing when a liquid surface level of working oil in the accumulation tank 12 varies from a level indicated by a double-dot line shown by an arrow "a", to another level indicated by another double-dot line shown by an arrow "b" in FIG. 3. In addition, the catch tank 13 has a capacity set to lie at a volumetric variation when the liquid surface level of working oil in the catch tank 13 varies from a distal end face of the external-air communication pipe 34 indicated by an arrow "c", to a level indicated by a double-dot line shown by an arrow "d" in FIG. 3, i.e., a level close proximity to a lower end of an inner bore of the connecting pipe 30.

With the reservoir device 10 of such a structure, if fluid flows from the external-air communication aperture 32 to the catch tank 13 along for instance the hypothetical streamline L1 shown in FIG. 3, fluid is forced to circumvent due to the presence of the first flow restricting plate 38. If fluid is gas, then, gas passes through a gap formed between the first and second flow restricting plates 38 and 39 to flow to the connecting port 28. In addition, if fluid is liquid, then, liquid flows along the streamline L2 shown in FIG. 3 to impinge upon the first flow restricting plate 38, and then liquid drops downward to flow along the bottom surface 36 to pass across the external-air communication aperture 32 to be discharged to the outside.

Figure 6:
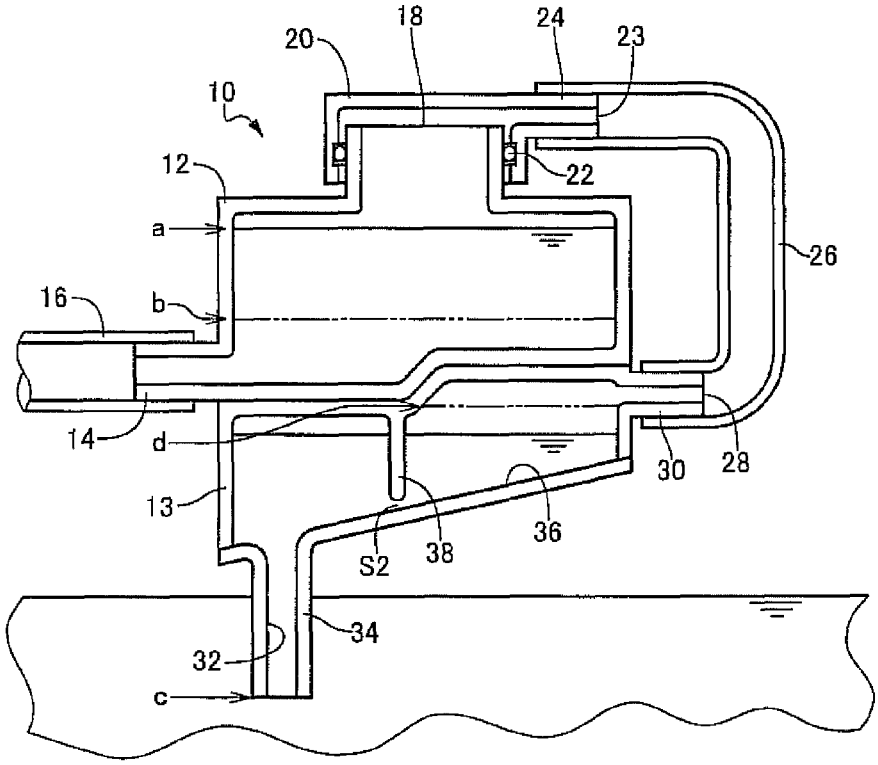
FIG. 6 is a cross-sectional view, showing a status wherein liquid is drawn up through an external-air communication aperture in the catch tank, when working oil drops in an accumulation tank from a predetermined uppermost liquid surface level to the lowermost liquid surface level with a whole of the reservoir device is soaked with liquid, which corresponds to FIG. 3.

Under a circumstance where for instance as shown in FIG. 6, if the distal end of the external-air communication pipe 34 is soaked in liquid, working oil in the accumulation tank 12 decreases from a predetermined uppermost oil surface level indicated by the arrow "a", to a lowermost oil surface level. When this takes place, liquid is drawn through the external-air communication aperture 32 and a whole of liquid is accommodated in a space beneath the lower end vicinity of the inner bore of the connecting pipe 30 at a position indicated by an arrow "d". In addition, a whole of liquid accumulated in the catch tank 13 is discharged from the external-air communication aperture 32 when the reservoir device 10 is escaped from a submerged state. When this takes place, liquid remaining in the inside of the catch tank 13 at a space between the connecting pipe 28 and the first flow restricting plate 38 passes through the gaps S1 and S2 to be discharged from the external-air communication aperture 32.

As set forth above, according to the reservoir device 10 of the present embodiment, the catch tank 13 is connected to the space "A" formed above the oil surface (liquid surface) of the working oil (working fluid) in the accumulation tank 12 and has the bottom surface (bottom portion) formed with the external-air communication aperture 32. Accordingly, liquid entering from the external-air communication aperture 32 is once accumulated in the catch tank 13, and thereafter suitably discharged through the external-air communication aperture 32. This prevents the accumulation tank 12 from flooding with water, and improves on-vehicle installation capability. Thus, the reservoir device 10 can be obtained, which prevents the inside or interior of the accumulation tank 12 from flooding with water. This is achieved even if the accumulation tank 12 is installed in a place or the like relatively closer to a road surface with an ease of suffering the splashing with water during for instance a traveling of a vehicle in rainy weather or during a traveling on a submerged road surface.

According to the reservoir device 10 of the present embodiment, the catch tank 13 has the capacity greater than the predetermined volumetric variation of the working fluid to be accumulated in the accumulation tank 12. Under a circumstance where for instance the distal end portion of the external-air communication pipe 34 is flooded with water, working oil in the accumulation tank 12 may decrease in level from the predetermined uppermost oil surface level to the lowermost oil surface level. Even with such an occasion, pressure variation occurs to allow a whole of liquid drawn through the external-air communication aperture 32 to be accommodated in the accumulation tank 12. Thus, even if the accumulation tank 12 is soaked with liquid, the inside of the accumulation tank 12 is prevented from flooding with water.

According to the reservoir device 10 of the present embodiment, the external-air communication aperture 32 is constructed of the inner bore of the external-air communication pipe (tubular member) 34 formed on the bottom portion of the catch tank 13 so as to protrude downward, and the bottom surface 36 of the catch tank 13 has the sloped shape descending toward the external-air communication aperture 32. Thus, the catch tank 13 has a structure that can discharge liquid accumulated therein, through the external-air communication aperture 32, so that liquid entering through the external-air communication aperture 32 can be efficiently discharged.

According to the reservoir device 10 of the present embodiment, the catch tank 13 internally has the first flow restricting plate 38 provided intersecting with the streamline L1 between the connecting port 28 formed in the catch tank in connection to the accumulation tank 12, and the external-air communication aperture 32. Accordingly, the flow path between the external-air communication aperture 32 and the connecting port 28 placed inside the catch tank 13, is lengthened by the provision of the first and second flow restricting plates 38 and 39. This prevents the accumulation tank 12 from flooding with liquid contained in fluid with the flow of such fluid directed from the external-air communication aperture 32 to the connecting port 28. Fluid may swiftly splash on the external-air communication aperture 32 from the outside or may be swiftly sucked through the external-air communication aperture 32 due to a rapid reduction in volume of working oil in the accumulation tank 12. Even under such situations, the first and second flow restricting plates 38 and 39 function to weaken momentum of such fluid, so that the accumulation tank 12 is prevented from flooding with water caused by the flow of fluid directed from the external-air communication aperture 32 to the connecting port 28.

According to the reservoir device 10 of the present embodiment, the accumulation tank 12 has the connecting port 23 communicating with the inside of the accumulation tank 12, the catch tank 13 is located in the space beneath the accumulation tank 12, and the connecting port 28 of the catch tank 13 and the connecting port 23 of the accumulation tank 12 are connected to each other through the rubber tube (connecting pipe) 26. Consequently, the accumulation tank 12 and the catch tank 13 are united to each other in a unitary structure, further improving on-vehicle installation capability. In addition, with the accumulation tank 12 having the connecting port 23 placed in a place above the connecting port 28 of the catch tank 13, liquid accumulated in the catch tank 13 hardly flows into the accumulation tank 12, thus preventing the accumulation tank 12 from flooding with water in a further increased effect.

According to the reservoir device 10 of the present embodiment, the accumulation tank 12 has the fill-in port 18 formed on the accumulation tank 12 at the upper portion thereof for filling the working fluid, and the cap 20 closing the fill-in port and being provided with the connecting port 23 of the accumulation tank 12. Thus, with the connecting port 23 of the cap 20 placed in a place above the connecting port 23 of the catch tank 13, liquid accumulated in the catch tank 13 hardly flows into the accumulation tank 12, thus preventing the accumulation tank 12 from flooding with water in a further increased effect.

According to the reservoir device 10 of the present embodiment, the gap S2 is provided between the first flow restricting plate 38 and the bottom surface 36 of the catch tank 13. Accordingly, the catch tank 13 has a structure wherein liquid accumulating at the space between the first flow restricting plate 38 and the connecting port 28 passes through the gap S2 to be easily discharged to the outside through the external-air communication aperture 32. This can discharge liquid accumulated in the catch tank 13 efficiently.

According to the reservoir device 10 of the present embodiment, the gap S1 is provided between the first flow restricting plate 38 and the side surface of the catch tank 13, the second flow restricting plate 39 is disposed between the gap S1 and the external-air communication aperture 32 intersecting with the streamline between the gap S1 and the external-air connection aperture 32, and the first and second flow restricting plates 38 and 39 form the labyrinth path in the catch tank 13 so as to extend from the external-air communication aperture 32 to the connecting port 28. Consequently, this lengthens the flow path between the external-air communication aperture 32 and the connecting port 28 within the catch tank 13. This prevents the accumulation tank 12 from flooding with liquid contained in fluid along with the flowing of fluid directed the external-air communication aperture 32 to the connecting port 28.

With a reservoir device of the type including a breather and a sub-tank or the like that are placed in the accumulation tank 12 in fluid communication therewith wherein the breather and the sub-tank need to be located at relatively high positions, piping spaces are required to locate delivery tubes for connecting the breather and the sub-tank to the accumulation tank 12. However, with the reservoir device 10 of the present embodiment, no need arises for the breather and the sub-tank to be located at such relatively high positions and for the piping spaces to be provided for the delivery tubes. When the sub-tank is provided, moreover, an air sump needs to be located at a relatively high position for the purpose of preventing air from being drawn into a liquid delivery pipe of a clutch device (hydraulic device), and a regular air-releasing work is required. However, the reservoir device 10 of the present embodiment has no such location and work.

While the present invention has been described above in detail with reference to one embodiment shown in the drawings, the present invention is not limited to such an embodiment and may be implemented in another mode.

Although the illustrated embodiment has been described above with the structure wherein, for instance, the catch tank 32 is fixedly located in the accumulation tank 12, the present invention is not limited to such a structure and these component parts may be separately located on for instance a vehicle body or the like.

With the present embodiment set forth above, further, although the connecting port 23 of the accumulation tank 12 is provided on the cap 20, it may be located on for instance the accumulation tank 12 at a side surface or an upper surface thereof.

Furthermore, although the present embodiment takes the structure wherein the connecting port 23 of the accumulation tank 12 is located at a position higher than the connecting port 28 of the catch tank 13 to preclude liquid accumulated in the catch tank 13 from flowing into the accumulation tank 12, the present invention is not limited to such a structure. For instance, another structure may be arranged such that the connecting port 23 of the accumulation tank 12 is located at a position lower than the connecting port 28 of the catch tank 13, and a mid-area of a connecting pipe for connecting the connecting ports 23 and 28 to each other is located at an upper space than the connecting port 28. This prevents liquid accumulated in the catch tank 13 from flowing into the accumulation tank 12.

Moreover, while the catch tank 13 is located below the accumulation tank 12 in the present embodiment set forth above, the present invention is not limited to such a structure, and the catch tank 13 may be located at a lateral side or an upper side of the accumulation tank 12. For instance, the catch tank 32 may be located to include the cap 20, which does not require rubber tube.

In the illustrated embodiment, moreover, the first flow restricting plate 38 provided in the catch tank 32 may have no need to be necessarily provided. Even with such a structure, a certain measure of advantageous effect can be obtained. In addition, described shape and structure of the first flow restricting plate 38 are mere illustrative examples of the present invention, and the first flow restricting plate 38 may be realized in other shapes and structures. In brief, it may suffice to have a labyrinth structure that can prevent fluid from flowing from the external-air communication aperture 32 to the connecting port 28.

In the illustrated embodiment, besides, although the bottom surface 36 of the catch tank 13 takes a sloped profile that is descended toward the external-air communication aperture 32, the present invention is not limited to such a structure, and the bottom surface 36 of the catch tank 13 may have on a flat plane. In addition, no need necessarily arises for the external-air communication aperture 32 to be located on the bottom surface 36 of the catch tank 13. For instance, the external-air communication aperture 32 may be located on the catch tank 13 at a side surface in the vicinity of the bottom surface 36 to render certain measure of advantageous effect.

In the illustrated embodiment, further, although the reservoir device 10 is of the type used for the clutch device, the present invention is not limited to the reservoir device 10 of such a type, and may be applied to for instance a vehicular hydraulic device such as a brake device and a power steering device or the like.

Although the embodiment described is to be considered only as illustrative of the present invention and no illustrative description will be made on every detail, the present invention may be implemented in various modifications and improvements in the light of knowledge of person skilled in the art.

What is claimed is:

1. A working fluid accumulation device for a hydraulic device having an accumulation tank connected to a vehicular hydraulic device to accumulate working fluid therein under an atmospheric pressure, the working fluid accumulation device comprising:

a catch tank being connected to a space formed above a liquid surface of the working fluid in the accumulation tank and having a bottom portion formed with an external-air communication aperture, the external-air communication aperture is formed so as to open inside the bottom portion.

2. The working fluid accumulation device according to claim 1, wherein:

the catch tank has a capacity greater than a predetermined volumetric variation of the working fluid to be accumulated in the accumulation tank.

3. The working fluid accumulation device according to claim 1, wherein:

the external-air communication aperture is constructed of an inner bore of a tubular member formed on the bottom portion of the catch tank so as to protrude downward; and a bottom surface of the catch tank has a sloped shape descending toward the external-air communication aperture.

4. A working fluid accumulation device for a hydraulic device having an accumulation tank connected to a vehicular hydraulic device to accumulate working fluid therein under an atmospheric pressure, the working fluid accumulation device comprising:

a catch tank being connected to a space formed above a liquid surface of the working fluid in the accumulation tank and having a bottom portion formed with an external-air communication aperture, the catch tank internally has a first flow restricting plate provided intersecting with a streamline between a connecting port formed in the catch tank in connection to the accumulation tank, and the external-air communication aperture.

5. The working fluid accumulation device according to claim 4, wherein:

a gap is provided between the first flow restricting plate and a bottom surface of the catch tank.

6. The working fluid accumulation device according to claim 4, wherein:

a gap is provided between the first flow restricting plate and a side surface of the catch tank;

a second flow restricting plate is disposed between the gap and the external-air communication aperture intersecting with a streamline between the gap and the external-air connection aperture; and the first and second flow restricting plates form a labyrinth path in the catch tank so as to extend from the external-air communication aperture to the connecting port.

7. A working fluid accumulation device for a hydraulic device having an accumulation tank connected to a vehicular hydraulic device to accumulate working fluid therein under an atmospheric pressure, the working fluid accumulation device comprising:

a catch tank being connected to a space formed above a liquid surface of the working fluid in the accumulation tank and having a bottom portion formed with an external-air communication aperture;

the accumulation tank has a connecting port communicating with an inside of the accumulation tank;

the catch tank is located in a space beneath the accumulation tank; and the connecting port of the catch tank and the connecting port of the accumulation tank are connected to each other through a connecting pipe.

8. The working fluid accumulation device according to claim 7, wherein:

the accumulation tank has a fill-in port formed on the accumulation tank at an upper portion thereof for filling the working fluid, and a cap closing the fill-in port and being provided with the connecting port of the accumulation tank.

* * * * *